United States Patent [19]

Meyer

[11] Patent Number: 4,603,863

[45] Date of Patent: Aug. 5, 1986

[54] TILTABLE GAME PIECES FOR USE WITH BOARD GAMES

[76] Inventor: William D. Meyer, 2816 Sutton Blvd., Maplewood, Mo. 63143

[21] Appl. No.: 682,248

[22] Filed: Dec. 17, 1984

[51] Int. Cl.[4] ..... A63F 3/00

[52] U.S. Cl. ..... 273/282; 273/282; 273/288

[58] Field of Search ..... 273/282 R, 282 B, 282 C, 273/128 R, 125 A, 288, 128 CS

[56] References Cited

U.S. PATENT DOCUMENTS

| | | | |
|---|---|---|---|
| 1,116,650 | 11/1914 | Waindle | 273/288 X |
| 3,192,650 | 7/1965 | Torchia | 273/282 R |
| 3,274,727 | 9/1966 | Zander | 273/282 X |
| 3,533,626 | 10/1970 | Smith | 273/128 R |
| 3,588,112 | 6/1971 | Holt | 273/282 C UX |
| 4,019,747 | 4/1977 | Chuilli | 273/288 X |

*Primary Examiner*—Richard C. Pinkham
*Assistant Examiner*—Matthew L. Schneider
*Attorney, Agent, or Firm*—Haverstock, Garrett & Roberts

[57] ABSTRACT

A game playing piece having a body with opposite surfaces one of which is positioned in engagement with a playing surface during playing of a game, the one surface of the game piece being constructed so that when a downwardly directed force is applied on one part of the playing piece it will cause another part of the playing piece to tilt upwardly away from the playing surface so that it can be taken hold of and lifted off the playing surface. The playing piece is made tiltable by providing a single projection or a plurality of projections on the one surface of the piece adjacent the peripheral edge. Alternatively, the playing piece can be provided with beveled peripheral edges.

7 Claims, 8 Drawing Figures

TILTABLE GAME PIECES FOR USE WITH BOARD GAMES

BACKGROUND OF THE INVENTION

1. Field of the Invention

The present invention pertains to a game playing piece or token for board games and the like and, in particular, to a shaped lower surface on the playing piece which enables the playing piece to be easily lifted from a surface, particularly of a game board.

2. Information Disclosure Statement

Many different types of game playing pieces are known. Common to many of them is that the playing piece is generally flat in shape and has distinctive markings on its upper surface. These markings, which may include numbers, letters, pictures or symbols, are used in a game to enable plays to be made. Many games utilizing flat playing pieces require that the pieces be placed on a playing surface or board, often adjacent one another in order that the marked upper surface may be used in the course of the game. Examples of placement of playing pieces on a playing surface are disclosed in Brunot British Pat. No. 747,598; Koiransky French Pat. No. 599,951; Hardesty U.S. Pat. No. 3,638,947; and Hoyles U.S. Pat. No. 4,244,580.

The flattened shape of the playing pieces used in the games of the above-named patents enables markings on the top surface thereof to be seen by all of the game players around the playing surface during the course of the game. However, the flattened shape also makes the playing pieces used in these games difficult to pick up from the playing surface. This is particularly true when several game pieces are adjacent one another, such as disclosed in FIG. 1 of the Hardesty patent, or when a playing piece is located within an elevated rectangular grid, such as shown in FIG. 1 of the Hoyles patent.

Play of these and other similar games is often disrupted by dislocation of playing pieces caused by attempts of a player to pick up one of the playing pieces from the board so that he or she may remove it, turn it over, or move it to a new location. In so moving a playing piece, a player often bumps or otherwise knocks out of place other playing pieces, which then must be moved back to their previous locations. This causes delays in the game and arguments between players over the proper prior locations and may even cause the game to be discontinued if the disturbance of the pieces or of the players is severe enough. All of this detracts from the primary objective of a game, which is to have fun.

SUMMARY OF THE INVENTION

The present invention overcomes these and other problems and disadvantages of the prior art and provides a game playing piece or token which may be easily lifted from a surface, such as a flat game board, without disturbing adjacent pieces or from a recess in a compartmented playing board. More specifically, the present invention provides a game playing piece with a shaped or contoured lower surface which enables a player to press downwardly on one portion of the playing piece thereby causing a second portion of the playing piece to be raised upwardly away from the playing surface so that the playing piece may be easily grasped, such as by placing one's thumb or finger under the raised edge.

The present playing piece generally is to be used in place of playing pieces which lie flat on a surface and which are therefore difficult to pick up, particularly when lying adjacent one another. The present playing piece may also be used in games wherein playing pieces are placed in recesses in a game board such as for use while travelling. The present playing piece may be of any shape, such as a round piece as used in checkers or backgammon, a square piece such as used in the well known board game bearing the trademark Scrabble, a rectangular piece as used in dominos, or a triangular piece.

The present invention is directed primarily toward the shape of the lower surface or back of a playing piece. This lower surface or back, which is intended for placement on a game playing surface or other surface, is provided with a fulcrum about which the body of the playing piece can be pivoted or rocked. The fulcrum is spaced inwardly from at least two diametrically opposite edges of the playing piece and is preferably closer to one edge of the playing piece than to the diametrically opposite edge. The fulcrum is also downwardly relative to the nearest edge of the playing piece.

The body of the playing piece pivots about the shaped lower surface as would a lever about a fulcrum. When downard pressure is applied to a portion of the body corresponding to a shorter end of the lever, the body portion corresponding to a longer end of the lever is caused to tip upwardly and rise above the playing surface where it may be grasped, such as by placing a finger or thumb beneath the raised portion. The game player then may lift the playing piece from the playing surface without disturbing the surrounding playing pieces.

In one embodiment of the present invention, the playing piece has a contoured lower surface which includes a hemispherically shaped protrusion that extends downwardly from a planar lower surface of the body and which acts as a fulcrum. In other embodiments, the playing pieces have protrusions of other shapes, such as a square or triangular shaped protrusion, on the planar lower surface. In still another embodiment, more than one protrusion may extend from the lower surface of a playing piece at spaced locations thereon so that the playing piece may be tilted by exerting downward pressure at more than one point on the playing piece body. Yet other embodiments include one or more angled or beveled surfaces adjacent the respective edges of the playing piece, the intersection of an angled surface and the planar bottom surface serving as a pivot edge.

During the playing of a game, playing pieces are frequently placed adjacent each other which would ordinarily make it difficult, if not impossible, to pick up or move about a playing piece without disturbing adjacent playing pieces. The present invention enables playing pieces to be easily picked up and thereafter moved about without disturbing adjacent playing pieces, thereby preventing delays and interruptions of the game.

A primary object of the present invention is to provide a game piece or token which is easier to remove from a game board than playing pieces of the prior art.

Another object is to provide an individual game playing piece which may be lifted from a game board without disturbing other game playing pieces on the board.

Another object is to provide a game piece with means for tilting a portion thereof away from a playing surface for easy removal therefrom.

Another object is to provide a game piece having a configuration that enables board games to be played without excessive disturbance of the playing pieces or disruption of the game.

Another object is to provide an inexpensive and simple construction for game pieces which facilitates their removal from a surface without disturbing adjacent pieces.

Another object is to provide a game playing token which can be easily picked up even by the handicapped and elderly.

Another object is to provide a flattened game playing piece which may be marked with letters and/or symbols yet is easy to lift from a surface.

Another object is to provide a game piece which is easy to make.

Another object is to provide a game piece which can make the playing of board games more fun.

BRIEF DESCRIPTION OF THE DRAWINGS

These and other objects and advantages of the present invention will become apparent to those skilled in the art after considering the following detailed specification of several preferred embodiments of the present device in conjunction with the accompanying drawings, wherein.

DETAILED DESCRIPTION OF SEVERAL EMBODIMENTS

Figure 1:
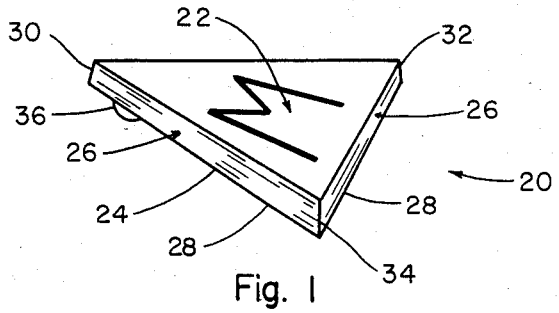
FIG. 1 is a perspective view of a game piece representing a preferred embodiment of the present invention.

Referring to the drawings more particularly by reference numbers wherein like numerals refer to like parts, FIG. 1 shows a game playing piece 20 constructed according to the teachings of the present invention. The game piece 20 includes a top surface 22, a lower surface 24 opposite the top surface 22 and shaped or contoured as will be described, and side walls 26 therebetween. The side walls 26 intersect the lower surface 24 to form lower edges 28. Although other shapes are contemplated, the game piece 20 is shown to be triangular with first, second and third corners 30, 32 and 34, respectively. The top surface 22 may be marked with a number, letter, picture or symbol, such as the letter "M" shown in FIG. 1, or it may be blank or have a distinctive color. The top surface 22 is preferably flat so that the markings thereon may be seen easily by all the players after the playing piece has been placed on a playing board or surface. The markings or other indications on the top surface 22 are used in a game to achieve the playing thereof.

Figure 2:
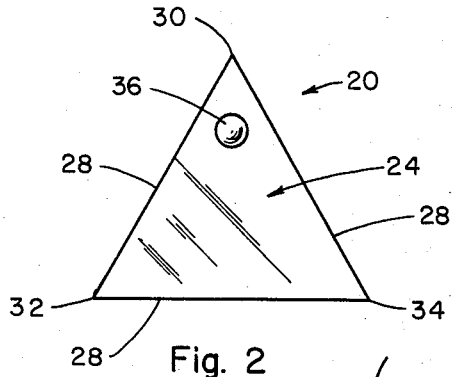
FIG. 2 is a bottom plan view of the embodiment of FIG. 1.
Figure 3:
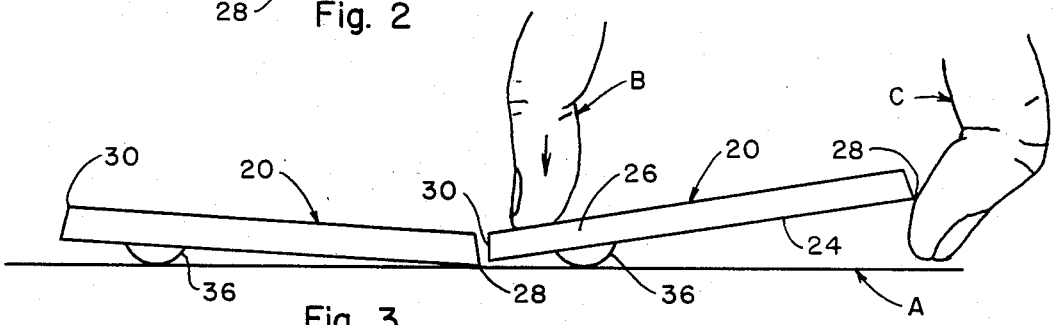
FIG. 3 is an enlarged side elevation view of the embodiment of FIG. 1 showing two game pieces, one of which is being lifted from a playing surface.

Rules of various games frequently require that several similar playing pieces be placed adjacent one another on a playing surface during the course of play, which can make the pieces difficult to pick up. Because the bottoms or lower surfaces of conventional playing pieces are normally flat, these conventional playing pieces are very difficult to grasp and lift from the surface of the game board. To solve this problem, the lower surface 24 of the present playing piece includes one or more downwardly extending projections that are strategically located as will be described hereinafter. In the embodiment of FIGS. 1, 2 and 3, the downwardly extending projection is a hemispherically shaped portion 36 on the lower surface 24 of the playing piece 20. The bottom plan view of FIG. 2 and side elevation view of FIG. 3 show more clearly the relationship of the hemispherically shaped projection 36 to the side walls 26 and its depth from the lower edges 28. The hemispherically shaped projection 36 is spaced somewhat from the lower edges 28 and it is preferably closer to a first corner 30 and relatively further from the second and third corners 32 and 34.

The relationship between the depth of the projection 36 and its distance from the sides 26 is important to the invention, as will now be explained. When the playing piece 20 is placed on a surface, such as a playing surface A, with its lower surface 24 facing downwardly, it rests on the hemispherically shaped portion 36 and on a diametrically opposed one of the lower edges 28. When a downwardly directed pressure is exerted on or near the first corner 30 nearest the projection 36, as by a finger B, as shown in FIG. 3, the playing piece 20 tilts about the hemispherically shaped portion 36, raising the diametrically opposed lower edge 28 from the surface A. The depth of the projection 36 and its distance from the sides 26 should be such that when the playing piece is pressed down at the first corner 30, the diametrically opposed edge 28 is raised sufficiently to permit a person's thumb or finger C to get under the raised edge 28. In the case of a triangular playing piece 20, it not only tilts upwardly but also somewhat to the side so that one of the two edges 28 that form the corner 30 contacts the playing surface A, thus raising either the corner 32 or the corner 34 further above the surface A than the rest of the piece 20. Thereafter, a player may lift the game playing piece 20 from the playing surface A without fumbling or dropping it and without disturbing adjacent playing pieces.

The present playing piece 20 also may have its side walls 26 formed at an acute angle to the lower surface 24 as shown in FIG. 3. This reduces the possibility of the side walls 26 contacting the side walls of adjacent playing pieces when the playing piece 20 is tilted.

When the playing piece 20 as just described is placed on a playing board A, the upper surface 22 lies at a slight angle or incline to the plane of the playing board A. The first corner 30 which is nearest the projection 36 lies further above the playing board A than does the rest of the playing piece. The raised corner 30 can therefore serve to indicate which portion is to be pressed to lift the piece 20 and it can be useful in the playing of the game, such as to indicate a direction. When several playing pieces 20 are placed together on a playing surface A, the inclined upper surfaces 22 can give an interesting effect to the assembled game. The angle at which the playing pieces lie is not severe enough, however, to prevent the top surfaces 22 of the playing pieces 20, and the markings thereon, from being seen by all those playing the game.

As previously mentioned, the relative dimensions of the playing piece 20, particularly with respect to the downwardly extending projection 36, are important insofar as the projection 36 must enable the playing piece 20 to be tiltable to an extent that enables a thumb or finger to lift the playing piece 20 from a surface. Many variations in dimensions are possible to achieve the desired result.

Figure 4:
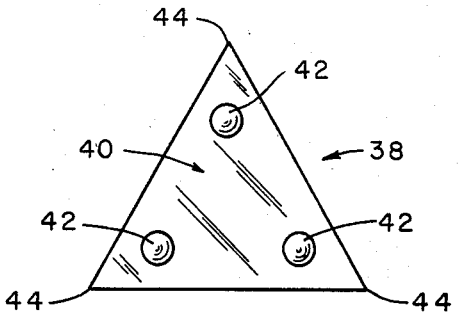
FIG. 4 is a bottom plan view of a second embodiment of the present invention.

Illustrating another embodiment of the invention, FIG. 4 shows a playing piece 38 having on its lower surface 40 a plurality of hemispherically shaped downwardly extending projections 42. Each of the downwardly extending projections 42 is spaced from a corresponding one of the corners 44 of the playing piece 38 and extends downwardly a sufficient distance to enable the playing piece 38 to be tilted and lifted as described above in conjunction with FIGS. 1–3. However, the plurality of downwardly extending projections 42 enables a player to tilt the game piece 38 by pressing downwardly near any one of the corners 44 rather than near only a particular corner. The projections 42 also enable an upper surface (not shown) to lie parallel to the playing surface A, which may be important in some cases.

Other shapes of downwardly extending projections may be used in place of the hemispherically shaped projections of FIGS. 1–4. These may include pyramid shaped projections, rectangular shaped projections, and ridges, as well as many other shapes. Depending on the overall shape of the playing pieces, other arrangements and/or numbers of downwardly extending projections different from those herein depicted may also be used to provide fulcrums about which game pieces may pivot and are therefore deemed covered by the present invention. It is only necessary that the downwardly extending projections be spaced from an edge of the playing piece and that they extend downwardly sufficiently to enable the game piece to tilt thereabout to lift a portion thereof from a surface so that it may be grasped.

Figure 5:
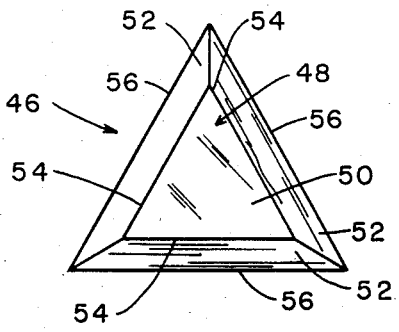
FIG. 5 is a bottom plan view of another embodiment of the present invention.

FIG. 5 shows another embodiment of a game piece 46 having a contoured lower surface 48 with means thereon to enable the playing piece 46 to be tilted. The lower surface 48 includes a substantially flat mid portion 50 lying within beveled surfaces 52 which mid portion 50 and beveled surfaces 52 intersect at edges 54. The beveled surfaces 52 are adjacent respective side walls 56 of the playing piece 46 and are at an acute angle to the mid portion 50. The mid portion 50 is planar in shape and substantially parallel to the plane of an upper surface (not shown) of the game piece 46, thus enabling the game piece 46 to lie flat on a game playing surface. It is also foreseen that the mid portion 50 may not be exactly parallel to the top surface. The game piece 46 can be tilted about any one of the edges 54 (or corners) in response to the exertion of a downwardly directed force near a corresponding one of the side walls 56 (or corners). The playing piece 46 may thereafter be lifted as described above.

Figure 6:
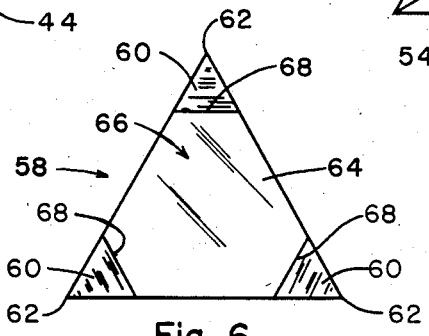
FIG. 6 is a bottom plan view of yet another embodiment of the present invention.

FIG. 6 shows a game piece 58 having beveled surfaces 60 located adjacent respective corners 62 thereof. The beveled surfaces 60 intersect a mid portion 64 of a lower surface 66 at respective fulcrum edges 68. The playing piece 58 can be tilted about any one of the fulcrum edges 68 when a downwardly directed force is exerted on a corresponding one of the corners 62. The playing piece 58 may thereafter be lifted from a playing surface as described above in conjunction with FIGS. 1–3.

Other types and arrangements of beveled surfaces may also be included in playing pieces constructed according to the present invention, including the provision of only one beveled surface adjacent either a side or corner of a playing piece.

Figure 7:
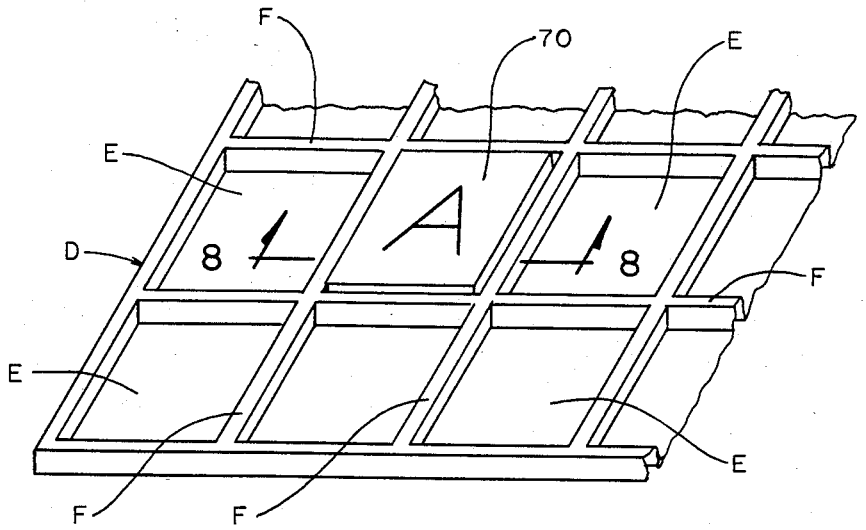
FIG. 7 is a perspective view of a portion of a game board intended for use while traveling and a game piece of the present invention lying within a recess therein.

FIG. 7 shows a portion of a game board surface D having recesses E therein, in one of which lies a playing piece 70 constructed according to the teachings of the present invention. The game board D may be used for playing many well known games and is particularly well suited for use while traveling where the motion of the car or other vehicle would cause the pieces to move if they were place on a flat playing surface. During the playing of a game, similar playing pieces 70 are placed within the recesses E where they are prevented from being moved about inadvertently.

Figure 8:
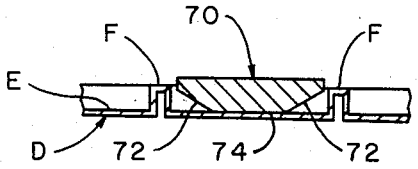
FIG. 8 is a cross section of the apparatus of FIG. 7 taken along lines 8—8 showing the subject playing piece within a recess in a game board.

While placing known type playing pieces within the recesses E would prevent disruptions of the game, it would also make removal difficult during the playing of the game. The present playing pieces 70, on the other hand, are relatively easy to remove from the recesses E. As can be seen more clearly in FIG. 8, beveled surfaces 72 are included on the lower surfaces 74 of the playing pieces 70 as described above. The beveled surfaces enable the playing pieces 70 to be titled while lying within the recesses E, after which the pieces 70 may be easily removed for whatever reason. The playing pieces 70 may alternately include projections or other shapes on their lower surfaces 74 as well (not shown).

Although the game board D is shown having recesses E formed by upwardly extending walls F in a grid pattern, many other types of game playing surfaces are foreseen on which games utilizing playing pieces of the present invention may be played. These include flat game boards on which playing pieces are placed adjacent one another on marked or unmarked locations on the board during the course of a game. The important thing is that the present game pieces may be lifted and removed from the game surface without dislocating other playing pieces, particularly those to which they are adjacent. This reduces delays in the game caused by replacing the pieces in their former positions and/or premature ending of the game, and may even prevent arguments among the players.

The game pieces constructed according to the teachings of the present invention are simple in construction and may be easily and inexpensively manufactured. Games using the present game pieces are more easily played, including by persons who have impaired coordination and muscle control such as by the mentally or physically handicapped and by elderly persons.

All of the embodiments disclosed herein enable a player to be able to easily remove a game playing piece from a surface with minimal disturbance to the game merely by exerting pressure downwardly on a portion of a playing piece and then grasping a tilted up portion. All of the embodiments disclosed herein include a playing piece body with a contoured lower surface defined by one or more projections extending therefrom and spaced inwardly from an edge or corner thereof to enable them to be tilted when pressed downwardly.

Thus, there has been shown and described an improved game playing piece construction having a shaped lower surface enabling the playing piece to be easily lifted from a playing surface, which game playing piece fulfills all of the objects and advantages sought therefor. It will be apparent to those skilled in the art, however, that many changes, variations, modifications, and other uses and applications of the subject device are possible, and all such changes, modifications, variations and other uses and applications which do not depart from the spirit and scope of the invention are deemed to be covered by the invention which is limited only by the claims which follow.

What is claimed is:

1. In a game comprising a plurality of playing pieces, each of said playing pieces including an upper portion having an upper surface with a playing indicia thereon and defined by an outer periphery, and supporting means including a playing surface thereon adapted to support a plurality of said playing pieces adjacent one another on said playing surface during playing of the game, the improvement comprising fulcrum means on each playing piece opposite from the upper portion, said fulcrum means including exactly one projection that is located away from the center of the piece and adjacent said outer periphery such that said projection is in contact with said playing surface when said playing piece is disposed on said playing surface, said projection being spaced inwardly a sufficient distance from said outer periphery and projecting downwardly a sufficient distance from the upper portion of said playing piece toward said playing surface so that application of a force directed downwardly against said upper surface adjacent said outer periphery in the area between the outer periphery and the projection causes said playing piece to pivot about said projection thereby causing downward pivoting of said playing piece adjacent to said projection toward said playing surface and causing upward pivoting of said playing piece on the opposite side of said projection to a position facilitating grasping of said playing piece for removal of said playing piece from said playing surface.

2. In the game of claim 1 wherein said playing piece is generally triangular in shape.

3. In the game of claim 1 wherein each playing piece includes a lower surface that faces said playing surface whereby different portions of said lower surface of said playing piece are spaced different distances from said playing surface when said projection is in contact with said playing surface.

4. In the game of claim 1 wherein said projection is substantially hemispherically shaped.

5. A game comprising a playing board having a playing surface, said playing surface having at least one recess formed therein, said recess having a planar surface and a peripheral recess wall extending from said planar surface to said playing surface, and at least one playing piece defined by a body of unitary construction having first and second opposite substantially parallel surfaces and a peripheral side wall extending therearound, the shape of said peripheral side wall conforming to the shape of said recess in said playing board whereby said playing piece is adapted to be placed in said recess, said first surface of said playing piece having fulcrum means located thereon for positioning said playing piece in said recess such that portions of said first surface are spaced different distances from said planar surface when said fulcrum means is in contact with said planar surface whereby when force is applied to said body opposite said first opposite surface portion on one side of said fulcrum means said playing piece will pivot about said fulcrum means to raise another of said surface portions of said playing piece out of said recess whereby said playing piece can be taken hold of and removed from said playing surface.

6. The game of claim 5 wherein said force is applied to said body opposite said first opposite surface portion on a predetermined one side of said fulcrum means.

7. In a game comprising a plurality of playing pieces, each of said playing pieces including an upper portion having an upper surface with a playing indicia thereon and defined by an outer periphery, and supporting means including a playing surface thereon adapted to support said plurality of playing pieces adjacent one another on said playing surface during playing of the game, the improvement comprising fulcrum means on each playing piece opposite from the upper portion, said fulcrum means including less than three spaced projections, each projection being located away from the center of the piece and adjacent said outer periphery such that said projections are in contact with said playing surface when said playing piece is disposed on said playing surface, each projection being spaced inwardly a sufficient distance from the outer periphery and projecting downwardly from the playing piece toward said playing surface so that application of a force directed downwardly against said upper surface adjacent said outer periphery in the area between the outer periphery and at least one of the projections causes said playing piece to pivot about said at least one of the projections thereby causing downward pivoting of said playing piece adjacent to said at least one projection toward said playing surface and causing upward pivoting of said playing piece on the opposite side of said at least one projection to a position facilitating grasping of said playing piece for removal of said playing piece from said playing surface.

* * * * *